US011435062B2

(12) United States Patent
Fiegener

(10) Patent No.: US 11,435,062 B2
(45) Date of Patent: Sep. 6, 2022

(54) TILT MECHANISM FOR ADJUSTING ILLUMINATION ANGLE OF A LIGHTING FIXTURE

(71) Applicant: Pure Forms, LLC, San Antonio, TX (US)

(72) Inventor: John Fiegener, Marblehead, MA (US)

(73) Assignee: Pure Forms, LLC, San Antonio, TX (US)

( * ) Notice: Subject to any disclaimer, the term of this patent is extended or adjusted under 35 U.S.C. 154(b) by 0 days.

(21) Appl. No.: 17/572,287

(22) Filed: Jan. 10, 2022

(65) Prior Publication Data

US 2022/0221137 A1 Jul. 14, 2022

Related U.S. Application Data

(60) Provisional application No. 63/135,411, filed on Jan. 8, 2021.

(51) Int. Cl.

| | |
|---|---|
| ***F21V 19/02*** | (2006.01) |
| ***F21V 19/00*** | (2006.01) |
| *F21Y 115/10* | (2016.01) |

(52) U.S. Cl.
CPC ..... *F21V 19/02* (2013.01); *F21V 19/001* (2013.01); *F21Y 2115/10* (2016.08)

(58) Field of Classification Search
CPC ..... F21V 19/02; F21V 21/30; F21V 21/14
See application file for complete search history.

(56) References Cited

U.S. PATENT DOCUMENTS

| | | | | |
|---|---|---|---|---|
| 10,801,708 | B1 * | 10/2020 | Morris | F21V 17/12 |
| 2014/0268836 | A1 * | 9/2014 | Thompson | F21V 21/30 362/427 |
| 2020/0348001 | A1 * | 11/2020 | Spicer | F21V 21/30 |

* cited by examiner

*Primary Examiner* — Karabi Guharay
(74) *Attorney, Agent, or Firm* — DuBois, Bryant & Campbell, LLP; William D. Wiese

(57) ABSTRACT

A device and method for adjusting a tilt angle of a tilt mechanism of an internal assembly of a lighting fixture is disclosed. The tilt mechanism comprises an inner base and an outer base. The inner base facilitates installation of a light engine for installation and operably engages with the outer base to vary a tilt angle of the lighting fixture, which can be adjusted by a tilt mechanism thumb actuator.

14 Claims, 11 Drawing Sheets

TILT MECHANISM FOR ADJUSTING ILLUMINATION ANGLE OF A LIGHTING FIXTURE

PRIORITY STATEMENT UNDER 35 U.S.C. § 119 & 37 C.F.R. § 1.78

This non-provisional application claims priority based upon prior U.S. Provisional Patent Application Ser. No. 63/135,411 filed Jan. 8, 2021 in the name of John Fiegener entitled "Tilt Mechanism for Adjusting Illumination Angle of a Lighting Fixture," the disclosures of which are incorporated herein in their entirety by reference as if fully set forth herein.

FIELD OF INVENTION

The present subject matter generally relates to a field of lighting and lighting fixtures recessed into a wall or ceiling. More particularly, the present subject matter relates to an arrangement for adjusting a tilt angle of a tilt mechanism of an internal assembly of a lighting fixture or apparatus.

BACKGROUND OF THE INVENTION

Interior designers and illumination engineers make use of different light sources and lighting angles to illuminate a specific zone or decorate a room. Among those, light emitting diode, LED, light sources are energy saving and are widely used in indoor and outdoor settings for illumination, especially indoors to decorate a room. For example, in certain lighting applications it is desirable to have the ability to adjust the angle of the light source so as to illuminate a specific area of a room or to provide a desired wall wash effect. The irradiating angle of such light source and the lighting fixtures is therefore important to vary the illumination field in the room.

Light fixtures known in the prior art incorporate various methods of adjusting an angle of an illumination lamp at the time it is installed in a ceiling. For example, double pivoting motion and other methods have been employed to adjust the angle of the light source. However, in many instances the angle must be adjusted at the time the lighting fixture is installed and, once it is installed, there is no easy way to alter the angle.

Therefore, there is a need for a tilt mechanism for adjusting illumination angle of a lighting fixture, where the mechanism facilitates installing the light source post-installation of the lighting fixture and after the room is finished.

SUMMARY OF THE INVENTION

Many of the deficiencies inherent in the prior art may be addressed by, among other methods and devices described herein, various embodiments of a tilt mechanism for adjusting the illumination angle of a lighting fixture.

Accordingly, one embodiment of the present invention includes a tilt mechanism for adjusting the illumination angle of a lighting fixture. The tilt mechanism may be activated from the room side of the light fixture through a rotation of a drive gear ring of an internal assembly of the lighting fixture, either in clockwise or counter-clockwise direction. based on the position of the lighting fixture and the amount of tilt desired by the user.

Another embodiment of the present invention includes a tilt mechanism which facilitates installing a light source into a light fixture after the light fixture has been installed in a wall or ceiling and after the wall or ceiling is finished.

Further advantages and examples of the invention are described further below, wherein the detailed description is provided for the purpose of fully disclosing various embodiments of the invention without placing limitations thereon.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the claims.

BRIEF DESCRIPTION OF THE DRAWINGS

In the following drawings like reference numbers are used to refer to like elements. Although the following figures depict various examples of the invention, the invention is not limited to the examples depicted in the figures.

DETAILED DESCRIPTION OF THE INVENTION

The present invention is directed to improved methods and systems for, among other things, adjusting the illumination angle of a lighting fixture. The configuration and use of the presently preferred embodiments are discussed in detail below. It should be appreciated, however, that the present invention provides many applicable inventive concepts that can be embodied in a wide variety of contexts other than adjusting an illumination angle. Accordingly, the specific embodiments discussed are merely illustrative of specific ways to make and use the invention, and do not limit the scope of the invention.

Various features and embodiments to facilitate various embodiments of the present invention, including a tilt mechanism for adjusting illumination angle of a lighting fixture, are explained in conjunction with the descriptions of FIG. 1 through FIG. 11.

In the lighting industry, LED light engines, or LLEs, are now being popularly used for illuminating indoor and outdoor places. An LLE is a combination of one or more LED modules, together with an LED driver (also known as electronic control gear, or ECG). Some LLEs contain an integrated driver, while some LLEs consist of one or more LED modules together with a separate driver. Therefore, an LED light engine is a device between a LED fixture (lighting fixture) and an LED luminaire. In the description herein, the terms "light source" and "light engine" have been interchangeably because they perform the same functionality—providing a source of illumination.

Figure 1:
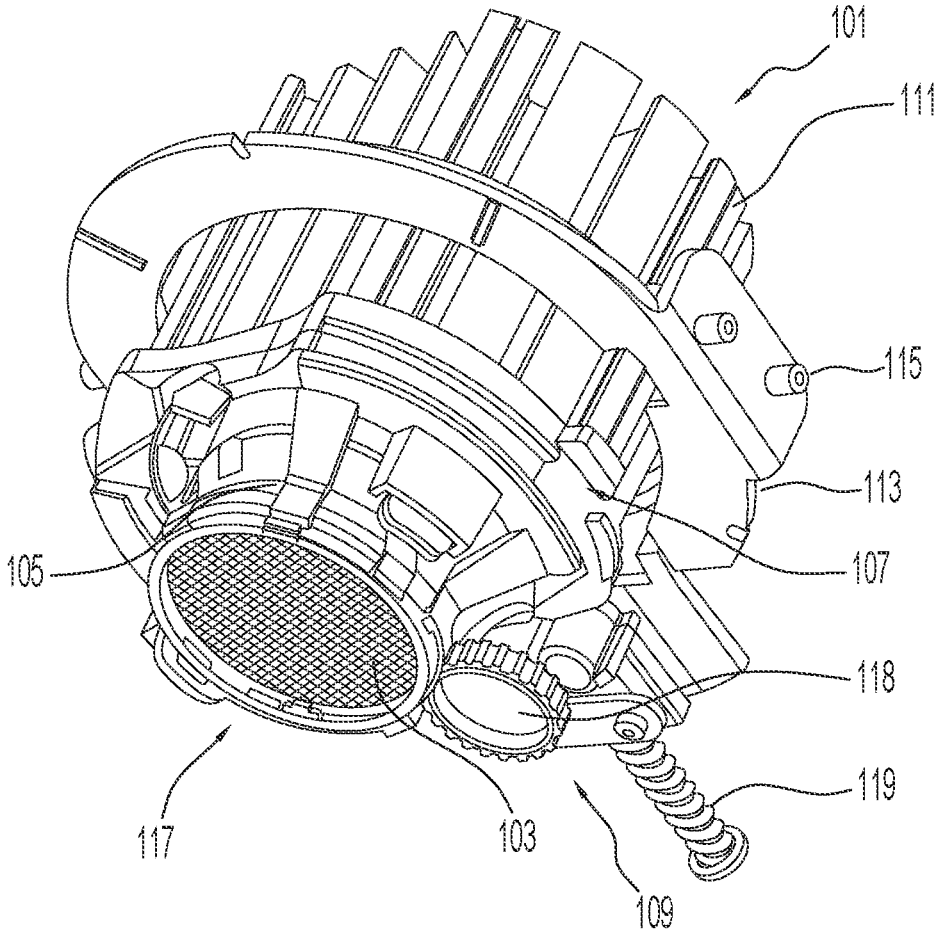
FIG. 1 illustrates a perspective view of a tilt mechanism for adjusting the illumination angle of a lighting fixture, where the light source is installed from the room side post-installation of the lighting fixture, in accordance with one embodiment of the present invention.

Referring now to FIG. 1, which shows an internal assembly 101 of a light fixture (not shown) configured with a light optic LED or LED module 103 as part of a light engine 105 positioned in a light engine holder 107 to adjust a tilt angle of a tilt mechanism 109 of the internal assembly 101, in accordance with one embodiment of the present invention. When installed in a floor or a ceiling, the light engine 105, preferably an LED light engine, or LLE, may be inserted or installed into an existing lighting fixture from the room side after the lighting fixture has already been installed in the wall or ceiling.

The light engine 105 consists of at least one LED or LED module 103, a heatsink 111 and a light engine holder 107. The light engine holder 107 is positioned in an inner base 113 which is configured with at least one "bayonet" cylindrical protrusion 115 on its edge that operably engages with at least one of the arcuate grooves 124 on the tilt mechanism 109 of the internal assembly 101 of the lighting fixture. The light engine 105 is inserted like a bayonet along the longitudinal axis 117 into the inner base 113 and rotated, thereby fixing the light engine 105 into the tilt mechanism 109 and holding it and, in some embodiments, locking it in place. The tilt mechanism 109 includes at least a tilt mechanism thumb actuator 118 and a tilt mechanism linear screw 119. The light engine 105 may be removed by reversing the insertion motion along the longitudinal axis 117.

Figure 2:
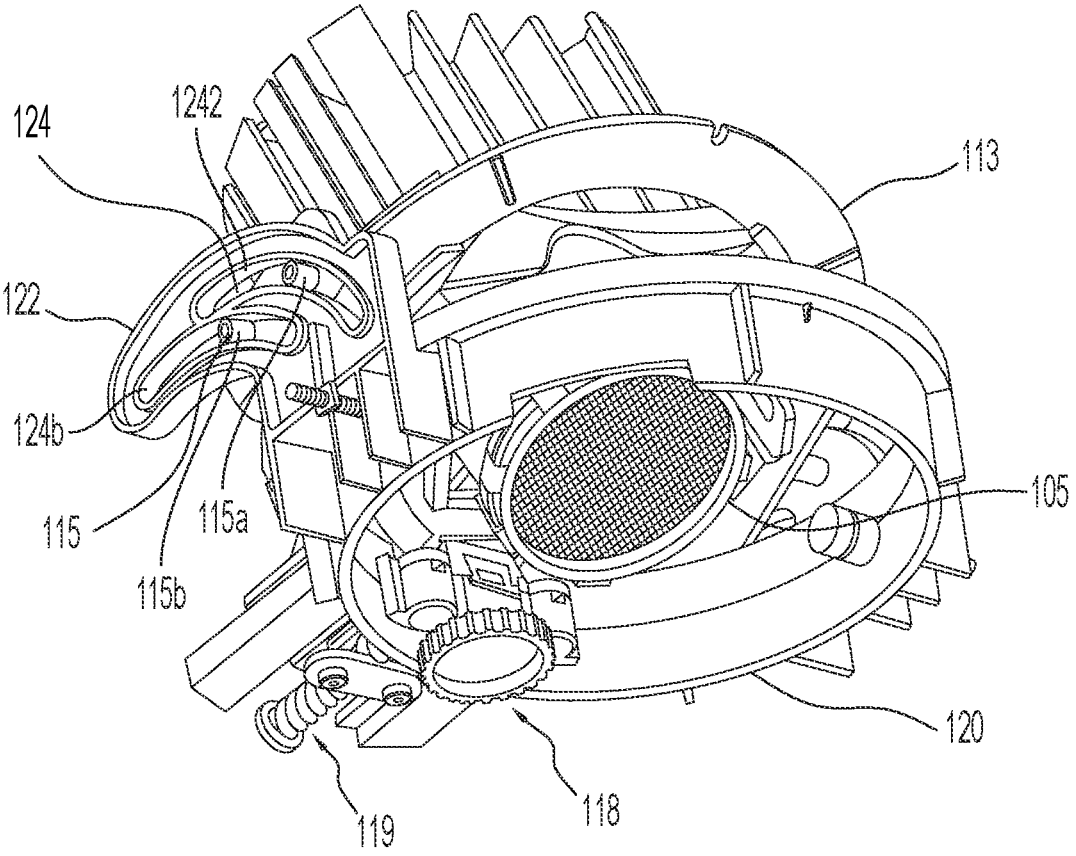
FIG. 2 illustrates a perspective view of a tilt mechanism for adjusting the illumination angle of a lighting fixture, where the light source along with the light source holder is in a tilted position, post-installation in the lighting fixture, in accordance with one embodiment of the present invention.

Referring now to FIG. 2 which depicts the inner base 113 positioned in an outer base 120. The outer base 120 is configured with arcuate grooves 124 within ear-shaped protrusions 122 attached to or incorporated into the outer base 120. The arcuate grooves 124 are configured to receive the cylindrical protrusions 115 attached to the inner base 113. As shown, the light engine 105, along with the light engine holder 107, is in a tilted position, post-installation in the outer base 120, in accordance with one embodiment of the present invention.

Those skilled in the art will appreciate that, as shown in FIG. 2, arcuate groove 124*a* is positioned in relation to arcuate groove 124*b* such that, as cylindrical protrusion 115*a* moves through arcuate groove 124*a* and cylindrical protrusion 115*b* moves through arcuate groove 124*b*, the inner base rotates with respect to the outer base. In other words, arcuate grooves 124*a* and arcuate groove 124*b* serve as guides to create a two point pivot system for the inner base which holds, and therefore also rotates, the LED engine.

Figure 3:
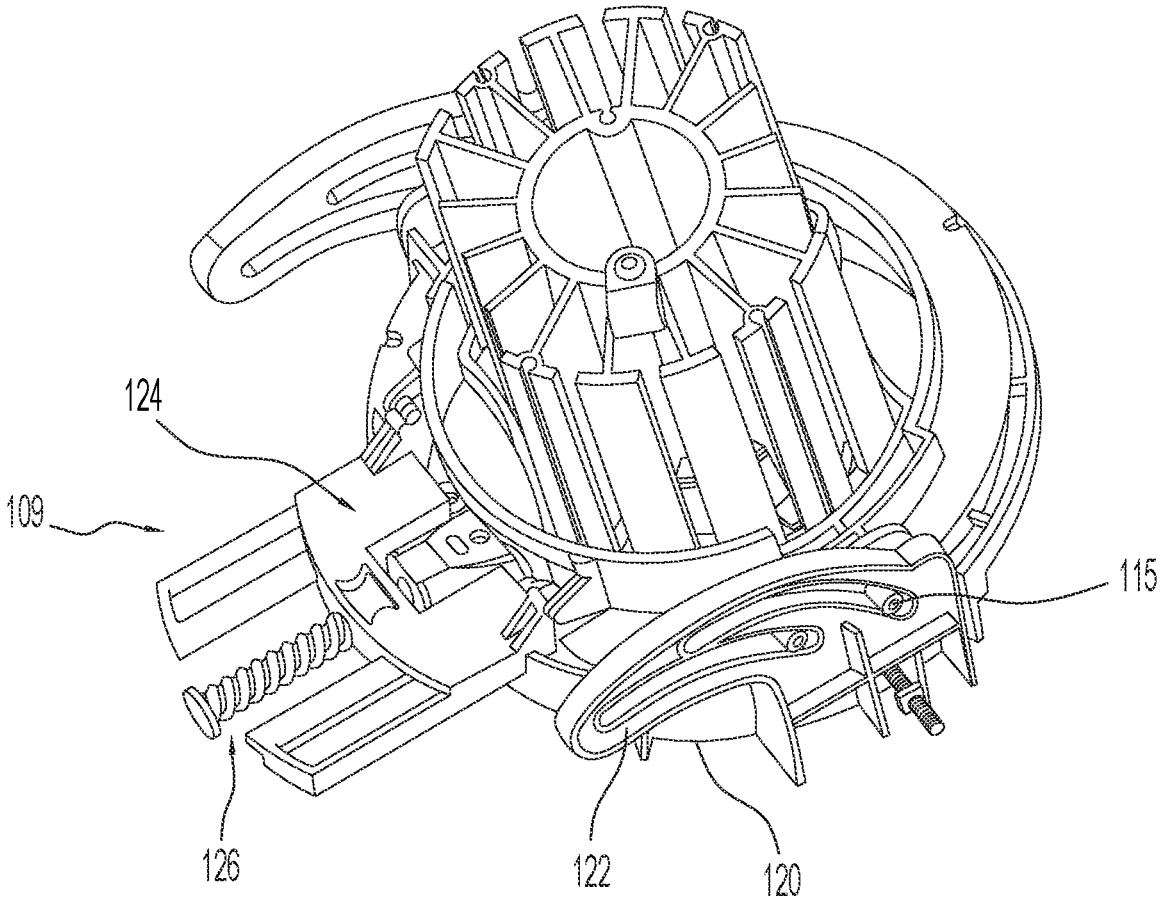
FIG. 3 illustrates a top perspective view of a tilt mechanism for adjusting the illumination angle of a lighting fixture, where the light source along with the light source holder is in a no-tilt position, post installation in the lighting fixture, in accordance with one embodiment of the present invention.

Referring now to FIG. 3 which depicts the tilt mechanism 109 comprising a tilt mechanism car 126 and a tilt mechanism screw 119 for adjusting the illumination angle of a lighting fixture, where the light engine 105, along with the light source holder 107, is in a down, or no-tilt, position after the outer base 120 has been installed in the lighting fixture.

More specifically, the tilt mechanism 109 comprises of an inner base 113 onto which the light engine 105 is inserted to form a bayonet, fixing and locking it in its place. The inner base 113 has at least one cylindrical protrusion 115 substantially spaced apart, on the outer surface of the inner base 113. As will be appreciated by those of skill in the art, although referred to herein as "cylindrical," the protrusion 115 may be partially cylindrical, oval, oblong or other shape or configuration which may be useful in optimizing the functionality and performance of the intended embodiment.

The tilt mechanism 109 further consists of an outer base 120 which has one or more ear shaped protrusions 122, substantially spaced apart. And the ear shaped protrusions 122 have arcuate grooves 124 therewithin, adapted to engage the protrusions 122 of the outer surface of the inner base 113, to facilitate movement of the inner base 113 relative to the outer base 120 of the tilt mechanism 109, and adjust an angle of the tilt mechanism 109 of the internal assembly of a lighting fixture.

In an exemplary implementation, the lighting fixture is circular, and the light engine 105 and the light engine holder 107 are also circular. The ear-shaped protrusions 122 of the outer base 120 are substantially placed diametrically opposite one another for better locking, movement and stability purposes of the light engine 105 and the lighting fixture. The inner base 113 is also circular in shape and has a plurality of substantially cylindrical protrusions 122 on either side. The cylindrical protrusions 122 of the inner base 113 are adapted to fit within the arcuate grooves 124 of the ear shaped protrusions 122 of outer base, and move along the arcuate grooves 124 as the tilt angle of the lighting fixture is varied.

In other exemplary embodiments, the lighting fixture, the light engine 105 and the light engine holder 107 may be substantially rectangular or square, or any other desired geometric shape.

The inner base 113 also may comprise a tilt mechanism thumb actuator (hereinafter referred to as a thumb screw) 118 and the tilt mechanism 109 is activated from the room side through the rotation of the thumb screw 118. The thumb screw 118 is either rotated clockwise or counter clockwise based on the position of the lighting fixture. Counter clockwise rotation of the thumb screw 118 acts as an actuator lowering the lighting fixture to a no-tilt or a 0 position or perpendicular position with respect to the wall or the ceiling into which the lighting fixture is installed. Conversely, clockwise rotation of the thumb screw 118 rotates the lighting fixture up to a dedicated angle, for example a 40-degree angle, with respect to the ceiling or wall into which the lighting fixture is installed.

The movement of the thumb screw 118 is proportional to the dedicated angle up to which the lighting fixture allows the tilt angle to be varied for illuminating a room, as per user needs. On rotation of the thumb screw 118, either clockwise or counter clockwise, the cylindrical protrusions 115 of the inner base 113 move up and down along the arcuate grooves 124 of the ear shaped protrusions 122 of the outer base 120 respectively. The total length of the arcuate grooves 124 is dependent on the maximum angle of tilt allowed by the lighting fixture. Also, the position of the cylindrical protrusions 115 in the arcuate grooves 124 of the ear shaped protrusions 122 is an indication of the amount of angle by which the lighting fixture has been tilted by a user.

Figure 4:
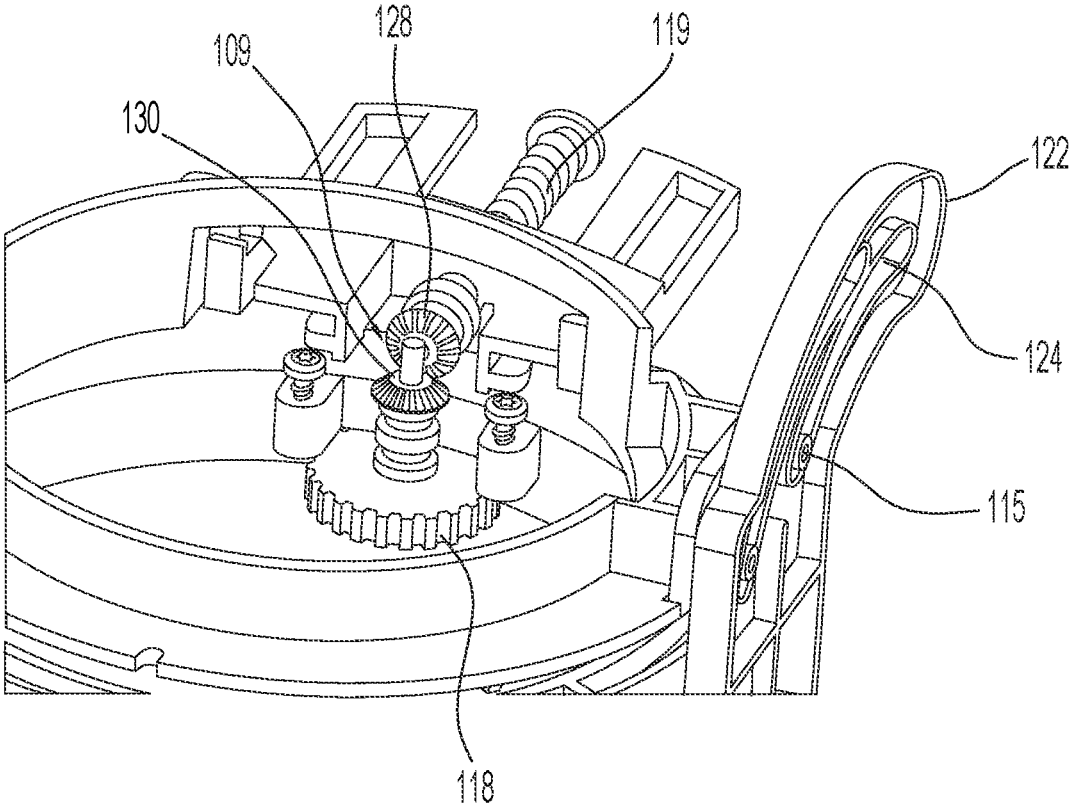
FIG. 4 illustrates an exploded internal view of a tilt mechanism of an internal assembly of a lighting fixture, in accordance with one embodiment of the present invention.

With reference now to FIG. 4 which shows an exploded internal top view of the tilt mechanism 109 of an internal assembly of a lighting fixture, in accordance with one embodiment of the present invention. The thumb screw 118 is connected to a first gear mechanism 128 that drives a second gear mechanism 130 that is perpendicular to the first gear mechanism 128. The first gear mechanism 128 includes a first bevel gear that is rotatably supported by a first pin, and the second gear mechanism 130 includes a second bevel gear that is rotatably supported by a second pin. The first pin of the first gear mechanism 128 is substantially 90 degrees apart from the second pin of the second gear mechanism 130. The second bevel gear 130 that is at 90 degrees or perpendicular to the thumb screw 118 is part of, or connected to, a tilt mechanism linear multithread screw 119. The linear multithread screw 119 is anchored in a tilt mechanism 'car' or 'shuttle' 126. On clockwise or counter-clockwise motion of the thumb screw 118, rotation motion of the thumb screw 118 is transferred by 90 degrees, to the linear multithread screw 119. As the thumb screw 118 is rotated, the linear multithread screw 119 moves forward or backward. Accordingly, the tilt mechanism car 126 moves forward or backwards pulling the light engine holder 107 from a no-tilt or 0 degree position to 40 degrees or from a 40 degree to a no-tilt or 0 degree position, depending on rotation of the thumb screw 118.

In another embodiment, the thumb screw 118 can be a mechanical fastener type head to be activated by a tool, such as an allen key or screw driver.

Figure 5:
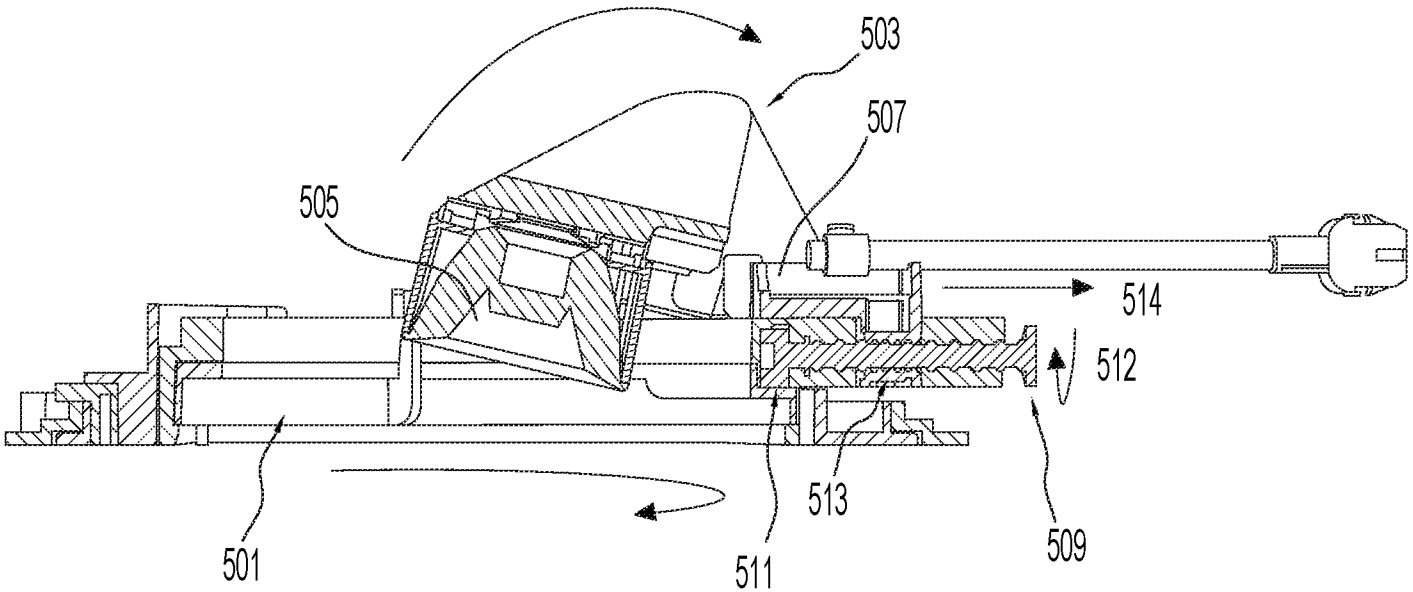
FIG. 5 illustrates a side view of another embodiment a tilt mechanism for adjusting the illumination angle of a lighting fixture.

Referring now to FIG. 5, which shows another embodiment of the present invention wherein the fixture is configured with a drive gear ring 501, a heatsink 503, a light engine 505 and a tilt mechanism car 507. The tilt mechanism car is configured with a screw drive 509, screw drive gear 511 and a car nut 512 so that, as the screw drive is rotated 512, the screw drive 509 rotates through the car nut 512 thereby causing the tilt mechanism car 507 to travel along the axis of travel 514.

Figure 6:
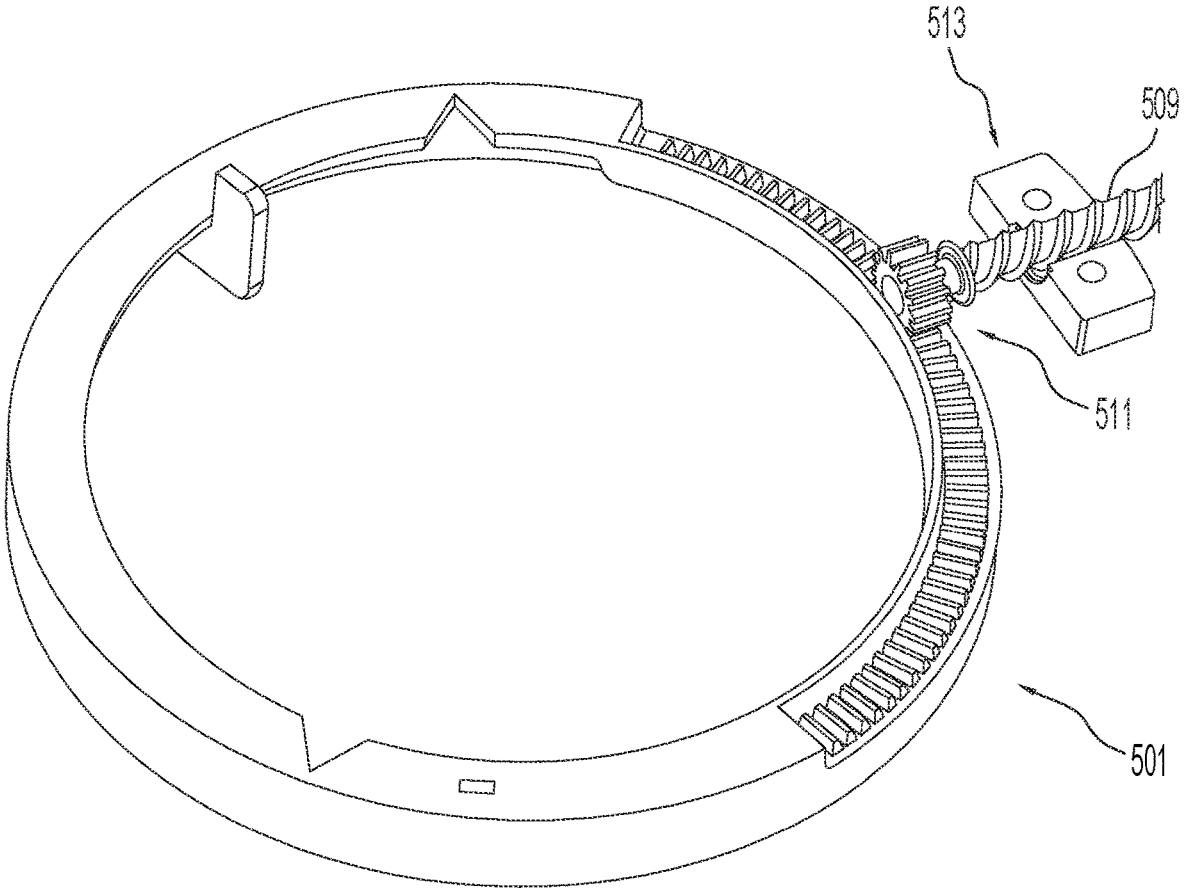
FIG. 6 illustrates a perspective view of the tilt mechanism of the embodiment of the invention presented in FIG. 5.

Referring now to FIG. 6 which shows an isolated view of the tilt mechanism wherein, as the screw drive 509 rotates, the teeth on the screw drive gear 511 rotate through the groves of the drive gear ring 501 thereby causing the drive gear ring 501 to rotate 502. The tilt mechanism 507 is controlled by a larger drive gear ring 501 that engages a smaller gear 511 located on the screw drive 509 that drives the car. The tilt mechanism car 507 is connected to the heatsink 503 that pulls the heatsink 503 along the upper guide rail 521 and the lower guide rail 519. Rotation of the gear ring 501 will either increase tilt or reduce tilt from 0 to 40 degrees.

Figure 7:
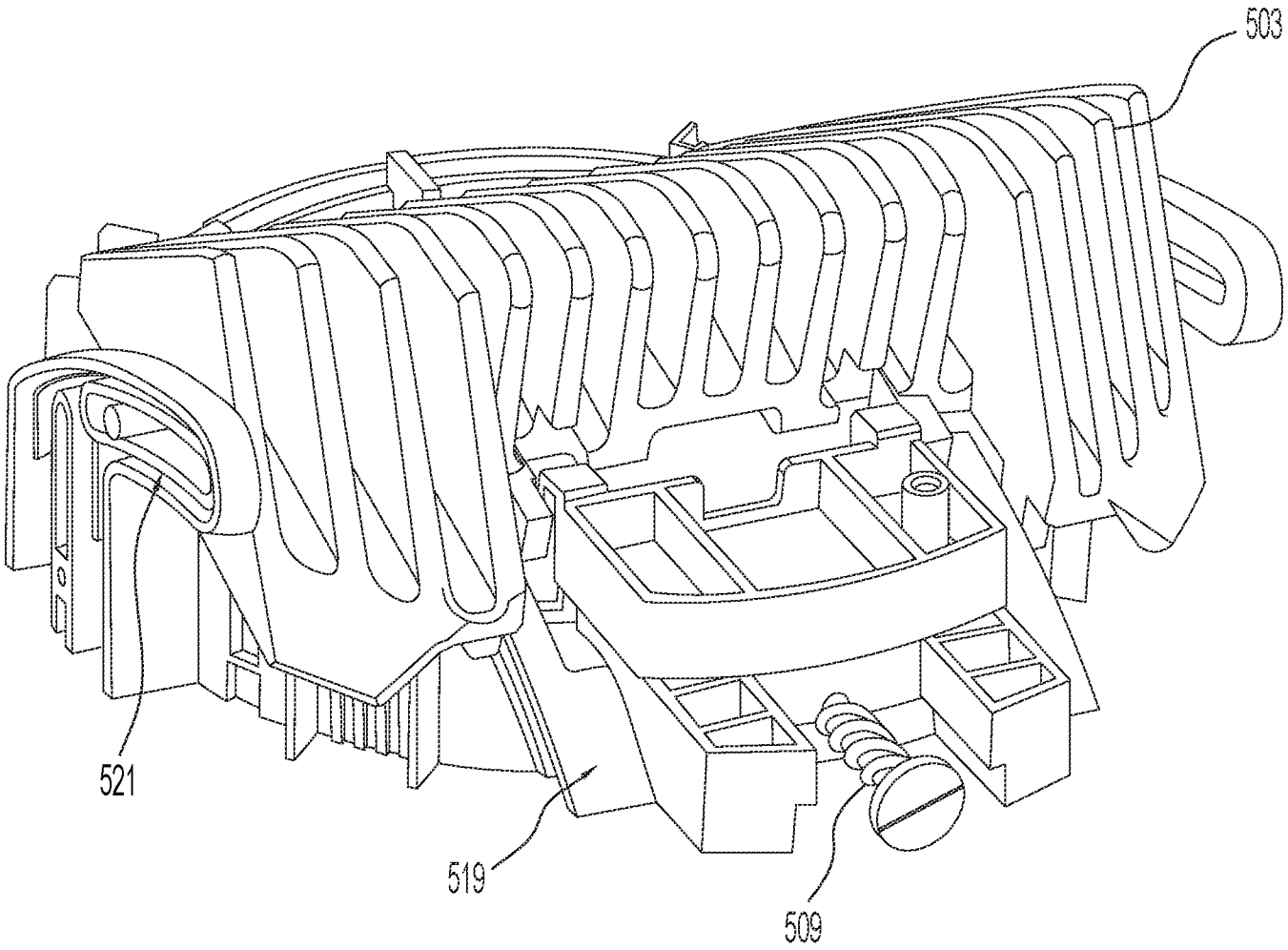
FIG. 7 illustrates a rear perspective of the outer base of the embodiment of the invention presented in FIG. 5.

FIG. 7 depicts the outer base wherein arcuate groove 521 in the ear-shaped protrusions forms an upper guide rail to guide the tilting process. This outer base is also configured with a lower guide rail 519 to assist in guiding the tilting process. This configuration is vastly different than fixtures known in the art in which with two guide rails are generally positioned in the same orientation and located in close proximity. In this embodiment of the invention, the arcuate groove 521 serves as an upper guide rail. This upper guide rail and the lower guide rail 519 are separated, and the lower guide rail 519 is below the heatsink 503 and is in an opposite orientation of the upper guide rail 521.

In contrast to the embodiment described above in which two arcuate grooves on the ear-shaped protrusions created a pivot system around which the inner base tilted, in this instance, the upper rail is positioned on the ear-shaped protrusion but the lower guide rail 519 is positioned in a manner in which the heat sink rests on it as the lower base tilts, thereby providing more stability to the tilting motion and less wear and tear on the lower guide rail and cylindrical protrusions of the previously-described embodiment.

Figure 8:
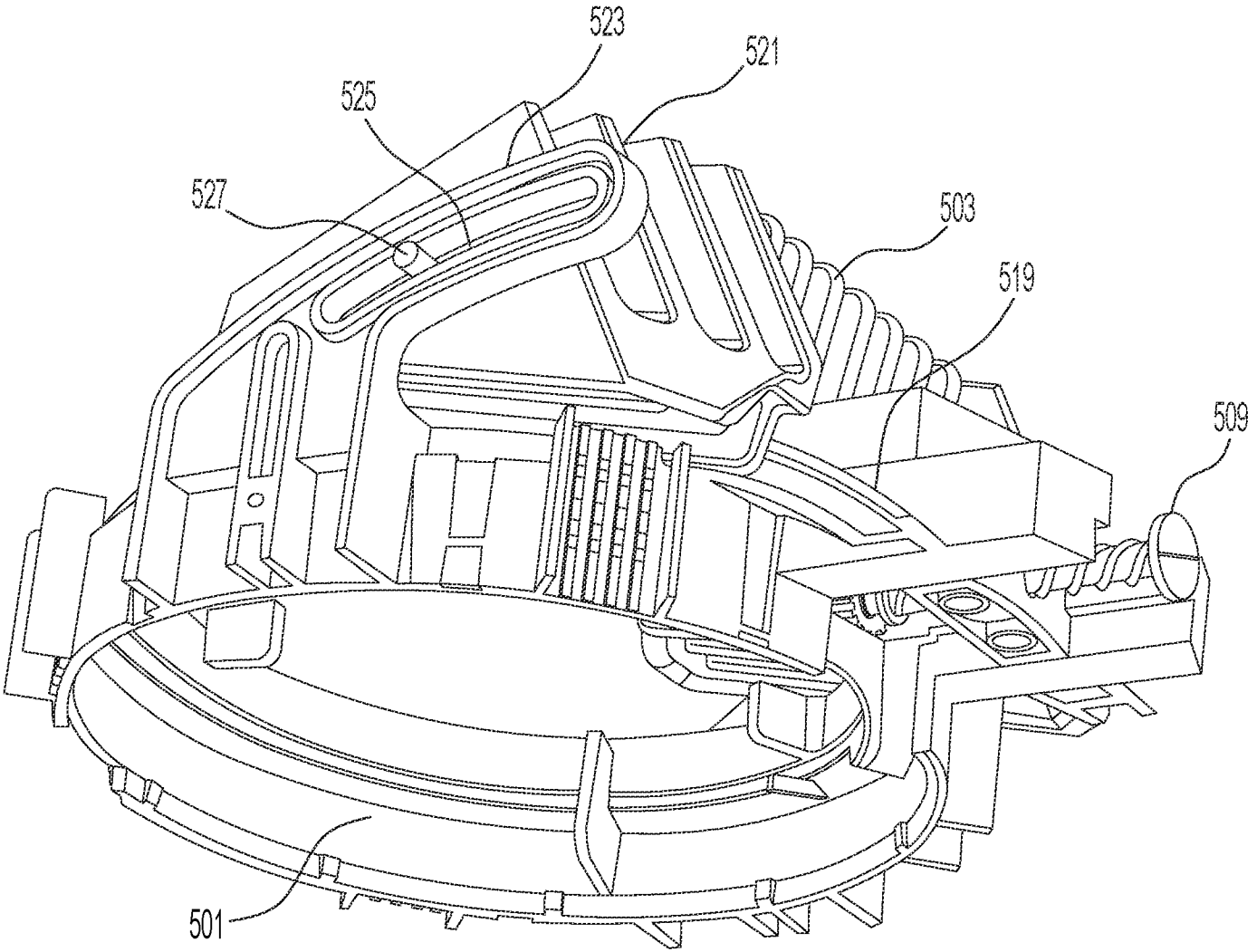
FIG. 8 illustrates a perspective view of the tilt mechanism of the embodiment of the invention presented in FIG. 5 positioned in the outer base of the embodiment of the invention presented in FIG. 5.

FIG. 8 shows the drive gear ring of FIG. 6 positioned in the outer base of FIG. 7. the outer base is configured with ear-shaped protrusions 523 having arcuate grooves 525 which form an upper guide rail 521. The arcuate grooves 525 are configured to receive cylindrical protrusions 527 attached to the inner base heatsink 503. The lower guide rail 519 and its interrelationship with the upper guide rail 521 can also be observed.

Figure 9:
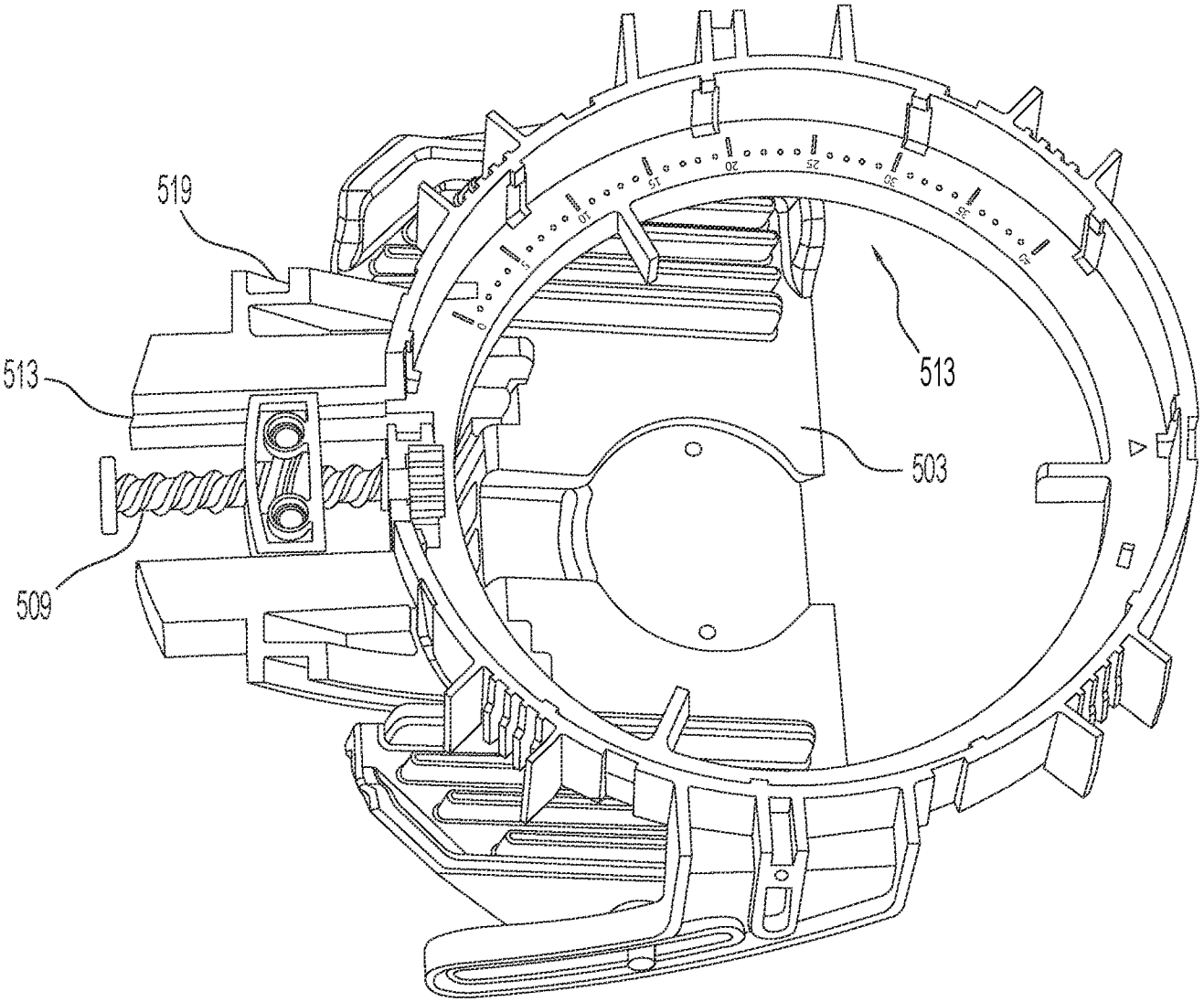
FIG. 9 illustrates a tilt indicator in the underside of the outer base of the embodiment of the invention presented in FIG. 5.

The underside of the outer base can be seen in FIG. 9. In this embodiment, a tilt indicator 517 is included on the underside of the outer base. In this instance the tilt indicator 517 is molded in the underside of the outer base, however the indicator could be embossed, affixed or incorporated into the base in other manners known in the art. In this embodiment, the user can see the angle of tilt while rotating the drive gear ring 501 through a window in the drive gear ring 501.

Figure 10:
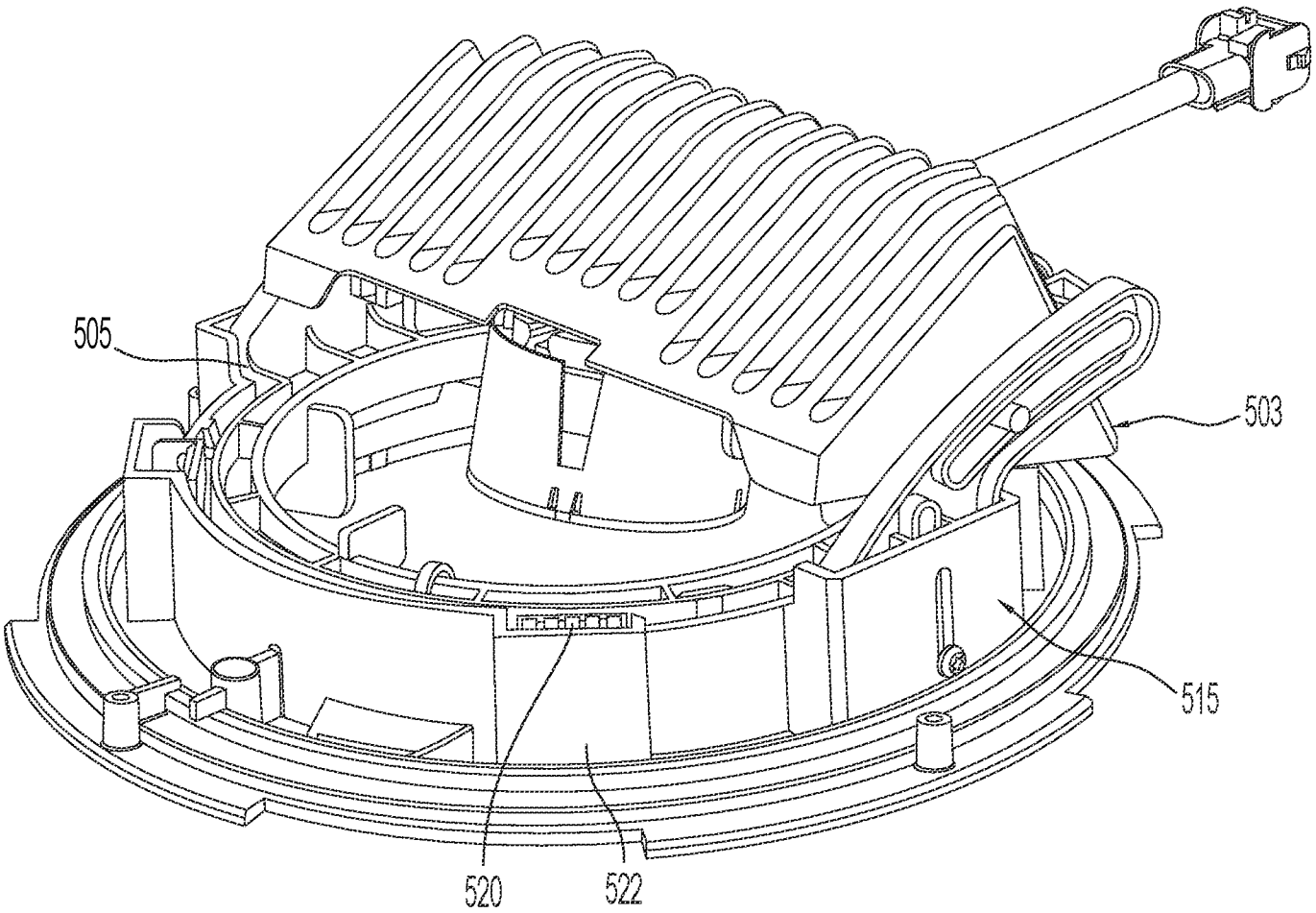
FIG. 10 illustrates the embodiment of the invention presented in FIG. 5 in the down position.
Figure 11:
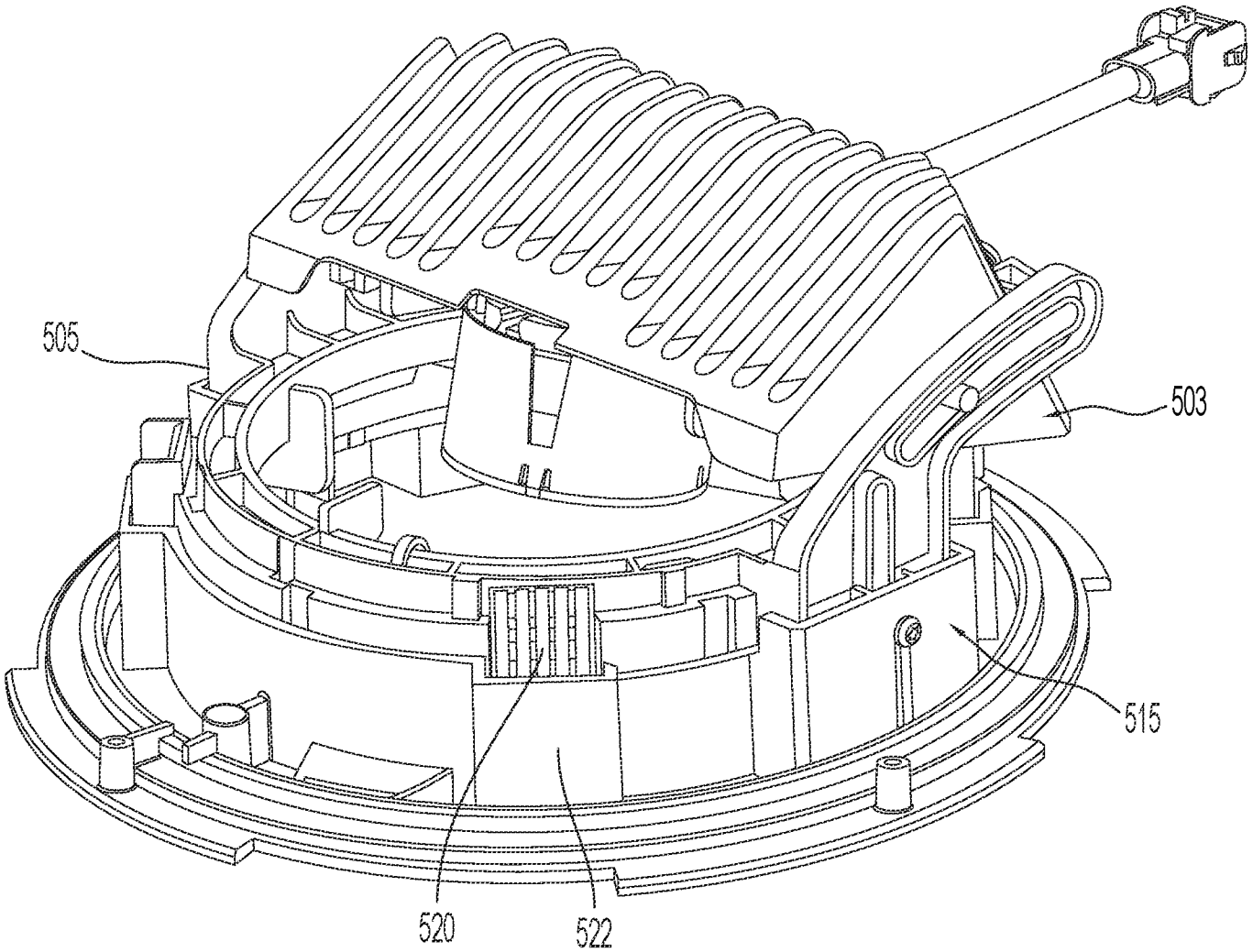
FIG. 11 illustrates the embodiment of the invention presented in FIG. 5 in an angled position.

Referring now to FIG. 10 and FIG. 11 which show the assembly described above positioned in an elevation ring 515 or an existing light fixture housing. In this instance, the outer ring is configured with an insert 520 on its outer edge which aligns with, and is positioned within, a channel 522 in the light fixture housing. This configuration allows the lighting assembly described above to be raised or lowered with respect to the light fixture housing. This feature is useful in increasing the visual cutoff of the light engine. For example, when the light fixture housing is installed in a ceiling, the protrusion 520 in the channel 522 allows a user to adjust the regress of the light engine by moving the lighting fixture up into the ceiling, thereby making the light engine more difficult to see from the room. This change can be made from the room side of the fixture, thereby allowing adjustments to the height of the light engine to be made quickly and efficiently. In FIG. 10, the light engine 505 is positioned in a lowered or down state and in FIG. 11, the light engine is positioned in a raised state.

As described above, one embodiment of the present invention includes a lighting assembly having a light engine positioned in a light engine holder, an outer base having ear-like protrusions with an arcuate groove configured therein, an inner base configured to receive the light engine holder and having cylindrical protrusions positioned to align with the arcuate groove of the outer base; a tilt mechanism attached to the outer base, the tilt mechanism having a linear screw which, when rotated, moves the tilt mechanism along an axis, thereby causing the cylindrical protrusions to move along the arcuate groove whereupon the angle of the inner base changes with respect to the outer base thereby changing the light engine's illumination angle.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of lighting fixtures known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

To aid the Patent Office and any readers of any patent issued on this application in interpreting the claims appended hereto, the applicant wishes to note that it does not intend any of the appended claims or claim elements to invoke 35 U.S.C. 112(f) unless the words "means for" or "step for" are explicitly used in the particular claim.

What is claimed is:

1. A lighting assembly comprising:

a light engine positioned in a light engine holder;

an outer base having ear-like protrusions with an arcuate groove configured therein;

an inner base configured to receive the light engine holder and having cylindrical protrusions positioned to align with the arcuate groove of the outer base;

a tilt mechanism attached to the outer base, the tilt mechanism having a linear screw which, when rotated, moves the tilt mechanism along an axis, thereby causing the cylindrical protrusions to move along the arcuate groove whereupon the angle of the inner base changes with respect to the outer base thereby changing the light engine's illumination angle.

2. The lighting assembly of claim 1, wherein two arcuate grooves in the ear-like protrusions form a two point pivot system.

3. The lighting assembly of claim 1, wherein the outer base is configured with a lower guide rail separated from the arcuate groove, wherein as the linear screw is rotated, the inner base travels along the lower guide rail.

4. The lighting assembly of claim 3, wherein travel of the cylindrical protrusions of the inner base through the arcuate grooves of the outer base, along with travel of the inner base along the lower guide rail, control tilt and pitch of the light engine.

5. The lighting assembly of claim 1, wherein the lighting assembly is configured to be inserted into an existing light fixture housing.

6. The lighting assembly of claim 1, wherein the light engine includes two or more LED lights.

7. The lighting assembly of claim 1, wherein the light engine is attached to a heatsink.

8. The lighting assembly of claim 1, wherein the inner base is configured to be rotatably insertable into the outer base.

9. The lighting assembly of claim 1, wherein the outer base is configured with two ear-shaped protrusions positioned on opposite sides of the outer base.

10. The lighting assembly of claim 1, wherein the ear-shaped protrusions of the outer base are configured with two or more arcuate grooves.

11. The lighting assembly of claim 1, wherein the linear screw is configured with a thumb actuator.

12. The lighting assembly of claim 11, wherein the lighting assembly is positioned in an existing light fixture housing and the thumb actuator is accessible and rotatable through the existing light fixture housing.

13. The lighting assembly of claim 11, wherein the lighting assembly is positioned in an existing light fixture housing, the outer ring having an insert and the light fixture housing having a groove, wherein the insert is configured to align with and be positioned inside the channel allowing the lighting assembly to be raised and lowered with respect to the light fixture housing.

14. The lighting assembly of claim 1, wherein the outer base is configured with a tilt indicator on its underside.

* * * * *